US007211159B2

(12) United States Patent
Taneike et al.

(10) Patent No.: US 7,211,159 B2
(45) Date of Patent: May 1, 2007

(54) FERRITIC HEAT-RESISTANT STEEL AND METHOD FOR PRODUCTION THEREOF

(75) Inventors: Masaki Taneike, Tsukuba (JP); Fujio Abe, Tsukuba (JP)

(73) Assignees: National Institute for Materials Science, Ibaraki (JP); Mitsubishi Heavy Industries, Ltd., Tokyo (JP)

( * ) Notice: Subject to any disclaimer, the term of this patent is extended or adjusted under 35 U.S.C. 154(b) by 97 days.

(21) Appl. No.: 10/311,755

(22) PCT Filed: Apr. 19, 2002

(86) PCT No.: PCT/JP02/03933

§ 371 (c)(1),
(2), (4) Date: Jun. 4, 2003

(87) PCT Pub. No.: WO02/086176

PCT Pub. Date: Oct. 31, 2002

(65) Prior Publication Data

US 2003/0188812 A1 Oct. 9, 2003

(30) Foreign Application Priority Data

Apr. 19, 2001 (JP) ..... 2001-121084

(51) Int. Cl.
*C22C 38/30* (2006.01)
*C22C 38/52* (2006.01)

(52) U.S. Cl. ..... 148/328; 148/326; 148/325; 148/333; 148/334; 148/335; 420/104; 420/107; 420/36

(58) Field of Classification Search ..... 148/326, 148/328, 333–335, 548, 663; 420/36–38, 420/104, 107, 108, 109–114
See application file for complete search history.

(56) References Cited

U.S. PATENT DOCUMENTS

| | | | | |
|---|---|---|---|---|
| 5,415,706 | A | 5/1995 | Searlin et al. | |
| 5,766,376 | A * | 6/1998 | Hasegawa et al. | 148/328 |
| 6,030,469 | A | 2/2000 | Ernst et al. | |
| 6,162,307 | A * | 12/2000 | Hasegawa et al. | 148/334 |
| 6,514,359 | B2 * | 2/2003 | Kawano | 148/328 |
| 6,712,913 | B2 * | 3/2004 | Hirata et al. | 148/325 |

FOREIGN PATENT DOCUMENTS

| | | |
|---|---|---|
| EP | 758025 | 2/1997 |
| JP | 7-18385 | 1/1995 |
| JP | 2000-273591 | 10/2000 |
| JP | 2002-4008 | 1/2002 |

* cited by examiner

*Primary Examiner*—Deborah Yee
(74) *Attorney, Agent, or Firm*—Wenderoth, Lind & Ponack, L.L.P.

(57) ABSTRACT

A ferritic heat-resistant steel, which exhibits excellent creep characteristics even at a high temperature exceeding 600° C., comprises, on the basis of percent by weight, 1.0 to 13% of chromium, 0.1 to 8.0% of cobalt, 0.01 to 0.20% of nitrogen, 3.0% or less of nickel, 0.01 to 0.50% of one or more of elements selected from a group consisting of vanadium, niobium, tantalum, titanium, hafnium, and zirconium that are MX type precipitate forming elements, and 0.01% or less of carbon and a balance being substantially iron and inevitable impurities, wherein the MX type precipitates precipitate on grain boundaries and in entire grains and the grain boundary existing ratio of an $M_{23}C_6$ type precipitate precipitating on the grain boundaries is 50% or less.

9 Claims, 3 Drawing Sheets

FERRITIC HEAT-RESISTANT STEEL AND METHOD FOR PRODUCTION THEREOF

TECHNICAL FIELD

The present invention relates to ferritic heat-resistant steel and a method of the manufacturing the same. More particularly, the present invention relates to ferritic heat-resistant steel excellent in creep characteristics even at a temperature exceeding 600° C. and a method of the manufacturing the same.

BACKGROUND ART

Austenite heat-resistant steel and ferritic heat-resistant steel have been employed as a high temperature member for power generation boilers and turbines, atomic power generation facilities, apparatuses in chemical industries, and the like because they are used for a long period of time at a high temperature under a high pressure. The ferritic heat-resistant steel is often used as a high temperature member at a temperature up to about 600° C. because it is less expensive than the austenite heat-resistant steel, has a smaller coefficient of thermal expansion, and is excellent in heat-resistant fatigue properties.

In contrast, recently, it has been examined to operate thermal power generation plants at a high temperature under a high pressure to increase an efficiency with a target of increasing a steam temperature of a steam turbine from the highest temperature of 593° C. at present to 600° C. and finally to 650° C.

In general, conventional ferritic heat-resistant steel is made by combining enhancement of precipitation achieved by an $M_{23}C_6$ type carbide precipitating on martensite grain boundaries and an MX type carbon-nitride dispersing and precipitating in grains with enhancement of a ferrite mother phase achieved by adding tungsten, molybdenum, cobalt, and the like, as disclosed in, for example, Japanese Patent No. 2948324. However, when the ferritic heat-resistant steel is subjected to creep at a temperature exceeding 600° C. for a long period of time exceeding 10,000 hours, the $M_{23}C_6$ type carbide is coarsened and the effect of enhancement of precipitation is reduced as well as a dislocation is actively recovered and a high temperature creep strength is greatly deteriorated. As disclosed in, for example, Japanese Patent Application Laid-Open (JP-A) No. 62-180039, a method of preventing the deterioration of the creep strength for a long period of time is to maintain the enhancement of precipitation by reducing an additive amount of carbon and precipitating a nitride that is more stable than a carbide at a high temperature and unlike to be coarsened. However, carbon is necessary to secure hardenability of the ferritic heat-resistant steel, and when carbon is simply reduced, the ferritic heat-resistant steel is not sufficiently hardened and a strength enhancing effect is reduced by a dislocation introduced in hardening. Thus, there has been not yet provided ferritic heat-resistant steel having a large creep strength for a long period of time at a high temperature exceeding 600° C.

DISCLOSURE OF THE INVENTION

In order to enhance a creep strength for a long period of time, the inventors of the present invention drastically reviewed an enhancement mechanism in ferritic heat-resistant steel and made a diligent study with the prospect of reducing an $M_{23}C_6$ type carbide that is liable to be coarsened and positively making use of an MX type nitride that is stable at a high temperature and further securing hardenability at the same time. As a result, the present invention has been completed by finding that a metal structure is formed in which the $M_{23}C_6$ that precipitates on grain boundaries is reduced to 50% or less and, on the other hand, an MX type precipitate precipitates on the grain boundaries and in grains by reducing an additive amount of carbon and adding a nitride and an MX forming elements to precipitate an MX type nitride and further by positively adding cobalt to secure hardenability and that ferritic heat-resistant steel having the metal structure exhibits a dramatically high creep strength at a high temperature.

That is, the present invention provides a ferritic heat-resistant steel which comprises, on the basis of percent by weight, 1.0 to 13% of chromium, 0.1 to 8.0% of cobalt, 0.01 to 0.20% of nitrogen, 3.0% or less of nickel, 0.01 to 0.50% of one or more of elements selected from a group consisting of vanadium, niobium, tantalum, titanium, hafnium, and zirconium that are MX type precipitate forming elements, and 0.01% or less of carbon and a balance being substantially iron and inevitable impurities, wherein the MX type precipitates precipitate on grain boundaries and in entire grains and the grain boundary existing ratio of an $M_{23}C_6$ type precipitate precipitating on the grain boundaries is 50% or less.

Further, the present invention provides ferritic heat-resistant steel wherein 0.001 to 0.030% of boron is included and/or wherein one or both of 0.1 to 3.0% of molybdenum and 0.1 to 4.0% of tungsten are included on the basis of percent by weight.

Further, the present invention provides a method of manufacturing ferritic heat-resistant steel which comprises the step of molding a material after it has been melted and then subjecting the molded material to a solution treatment at a temperature of 1000° C. to 1300° C. with respect to the manufacture of any one of the above ferritic heat-resistant steels.

Then, the present invention provides a method wherein a temper treatment is executed at a temperature of 500 to 850° C. after the completion of solution treatment.

The ferritic heat-resistant steel and the method of manufacturing the same of the present invention will be described below in more detail while showing examples.

BEST MODE FOR CARRYING OUT THE INVENTION

Figure 1:
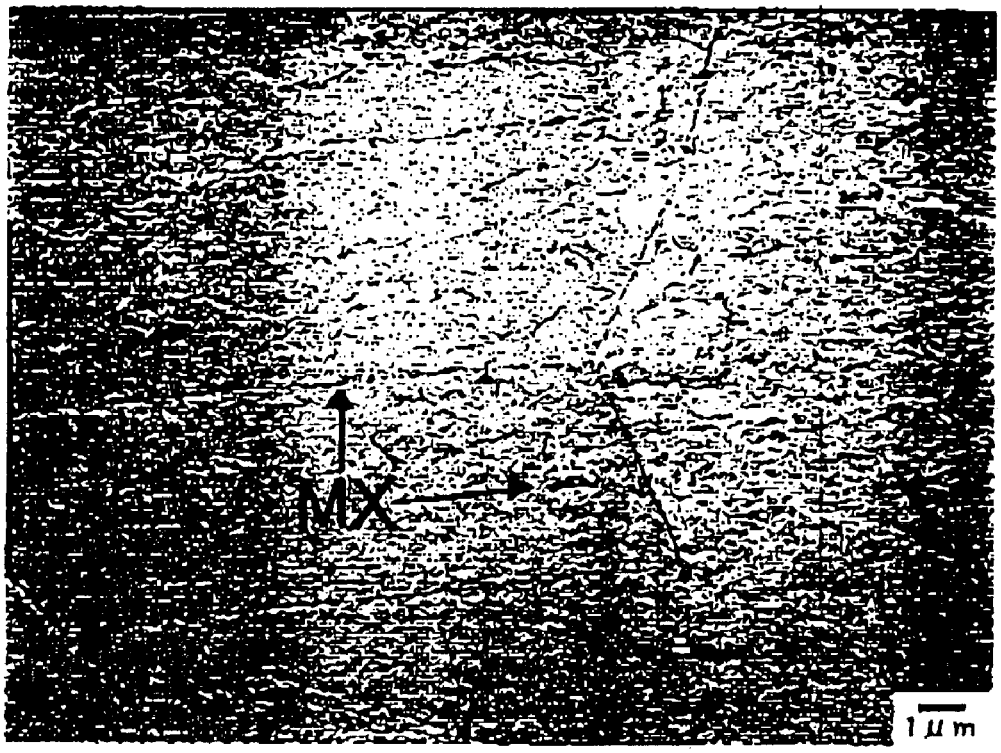
FIG. 1 is an image showing a metal structure of No. 2 ferritic heat-resistant steel, which will be described below, recorded by a transmission electron microscope.

In a ferritic heat-resistant steel and a method of manufacturing the same of the present invention, an enhanced structure of the steel is based on precipitating a fine MX type precipitate on grain boundaries and in entire grains to realize ferritic heat-resistant steel having a high creep strength at a high temperature. To precipitate the MX type precipitate, it is indispensable to solid-solubilize an MX type precipitate forming element in austenite at the time of solution treatment, and, for this purpose, a solution treatment temperature of 1000° C. or higher is necessary. In contrast, when the solution treatment temperature exceeds 1300° C., δ-ferrite precipitates and a high temperature strength is deteriorated thereby. Thus, in the method of manufacturing the ferritic heat-resistant steel of the present invention, the solution treatment temperature is set in a range of 1000 to 1300° C.

Note that in the method of manufacturing the ferritic heat-resistant steel of the present invention, the high temperature strength of the ferritic heat-resistant steel can be enhanced by creating a fine carbon-nitride. To sufficiently precipitate the fine carbon-nitride, a temper treatment can be executed at a temperature of at least 500° C. after the solution treatment is finished. In contrast, when the temper treatment temperature exceeds 850° C., the carbon-nitride is coarsened and the high temperature strength is deteriorated as well as a dislocation is greatly recovered and a room temperature strength is also deteriorated. Thus, an appropriate temper treatment temperature is in a range of 500 to 850° C.

Then, in the method of manufacturing the ferritic heat-resistant steel of the invention of the present application, it is essential to use a material containing specific constituting elements as described above in specific amounts. The features of the respective constituting elements and reasons for prescribing the contents of them are as described below. Note that, in the following description, the contents of the respective constituting elements are shown by percent by weight.

Chromium: Chromium is necessary in an amount of at least 1.0% for applying oxidation resistance and anti-corrosion to the steel. However, when it is contained in an amount exceeding 13%, δ-ferrite is created and the high temperature strength and toughness are deteriorated. Thus, the chromium content is set to 1.0 to 13%.

Cobalt: Cobalt greatly contributes to the suppression of precipitation of δ-ferrite. To enhance hardenability, cobalt is required in an amount of at least 0.1%. However, when the content exceeds 8.0%, ductility is deteriorated and a cost is increased. Thus, the cobalt content is set to 0.1 to 8.0%.

Nitrogen: Nitrogen enhances the hardenability as well as forms the MX type precipitate and contributes to the enhancement of the creep strength. Thus, nitrogen is required in an amount of at least 0.01%. However, when the content exceeds 0.20%, the ductility of the steel is deteriorated. Accordingly, the nitrogen content is set to 0.01 to 0.20%.

Nickel: When nickel exceeds 3.0%, the creep strength is greatly deteriorated. Thus, the nickel content is set to 3.0% or less.

MX Type Precipitate Forming Elements:

Vanadium: Vanadium forms a fine carbon-nitride, suppresses the recovery of dislocation in creep, and greatly enhances a creep breaking strength. When the strength of the steel is increased by adding another MX type precipitant forming element, the addition of vanadium may be omitted. However, a higher strength can be obtained by the addition of vanadium. An effect of addition of vanadium is outstanding in an amount of at least 0.01%. However, when the content exceeds 0.50%, the toughness is deteriorated as well as a coarsened nitride is created, and the creep strength is deteriorated. Thus, the vanadium content is set to 0.01 to 0.50%.

Niobium: Niobium forms a fine carbon-nitride, suppresses the recovery of dislocation in the creep, and greatly enhances the creep breaking strength similarly to vanadium. Moreover, since the crystal grains of the steel is refined by the fine carbon-nitride precipitating in hardening, the toughness is also enhanced. To obtain these effects, niobium must be added in an amount of at least 0.01%. However, when the content exceeds 0.50%, an amount of niobium that is not solid-solubilized in the austenite increases and the creep breaking strength is deteriorated. Thus, the niobium content is set to 0.01 to 0.50%.

Tantalum: Tantalum forms a fine carbon-nitride, suppresses the recovery of dislocation in the creep, and greatly enhances the creep breaking strength similarly to niobium. In contrast, when the strength of the steel is increased by adding another MX type precipitant forming element similarly to vanadium, the addition of tantalum may be omitted. However, a higher strength can be obtained by the addition of tantalum. An effect of addition of tantalum is outstanding in an amount of at least 0.01%. However, when the content exceeds 0.50%, the toughness is deteriorated as well as a coarsened nitride is created and the creep strength is deteriorated. Thus, the tantalum content is set to 0.01 to 0.50%.

Titanium: Titanium forms a fine carbon-nitride, suppresses the recovery of dislocation in the creep, and greatly enhances the creep breaking strength similarly to niobium. In contrast, when the strength of the steel is increased by adding another MX type precipitant forming element similarly to tantalum, the addition of titanium may be omitted. However, a higher strength can be obtained by the addition of titanium. An effect of addition of titanium is outstanding in an amount of at least 0.01%. However, when the titanium content exceeds 0.50%, the toughness is deteriorated as well as a coarsened nitride is created and the creep strength is deteriorated. Thus, the titanium content is set to 0.01 to 0.50%.

Hafnium: Hafnium forms a fine carbon-nitride, suppresses the recovery of dislocation in the creep, and greatly enhances the creep breaking strength similarly to niobium. In contrast, when the strength of the steel is increased by adding another MX type precipitant forming element similarly to titanium, the addition of hafnium may be omitted. However, a higher strength can be obtained by the addition of hafnium. An effect of addition of hafnium is outstanding in an amount of at least 0.01%. However, when the hafnium content exceeds 0.50%, the toughness is deteriorated as well as a coarsened nitride is created and the creep strength is deteriorated. Thus, the hafnium content is set to 0.01 to 0.50%.

Zirconium: Zirconium forms a fine carbon-nitride, suppresses the recovery of dislocation in the creep, and greatly enhances the creep breaking strength similarly to niobium. In contrast, when the strength of the steel is increased by adding another MX type precipitant forming element similarly to hafnium, the addition of zirconium may be omitted. However, a higher strength can be obtained by the addition of zirconium. An effect of addition of zirconium is outstanding in an amount of at least 0.01%. However, when the content exceeds 0.50%, the toughness is deteriorated as well as a coarsened nitride is created and the creep strength is deteriorated. Thus, the zirconium content is set to 0.01 to 0.50%.

At least two kinds of the MX type precipitate forming elements can be contained, in addition to one kind thereof. However, when at least two kinds of the MX type precipitate forming elements are contained, the total content thereof is set to 0.01 to 0.50% in total.

Carbon: Carbon enhances the hardenability and contributes to the formation of a martensite structure. However, carbon forms an $M_{23}C_6$ type precipitate that is liable to be made to a coarsened carbide and suppresses the precipitation of the fine MX type precipitate on the grain boundaries as described above. Thus, in the method of manufacturing the ferritic heat-resistant steel of the present invention, an effect of enhancing the hardenability achieved by the carbon is realized by the cobalt and nitride described above, thereby the hardenability are secured, the carbon content is suppressed as much as possible, and the existing ratio of the $M_{23}C_6$ type precipitate precipitating on the grain boundaries is limited to 50% or less. From the above point of view, the carbon content is set to 0.01% or less.

The following elements may be contained additionally in a material in the method of manufacturing the ferritic heat-resistant steel of the present invention.

Boron: Boron has an effect of increasing the strength of the grain boundaries as well as increasing the high temperature strength when it is added in a slight amount. When the strength of the steel is already increased by the elements described above, the addition of boron may be omitted. While an effect of addition of boron is outstanding in an amount of at least 0.001%. However, when the amount exceeds 0.030%, the toughness is deteriorated. Thus, the boron content is set to 0.001 to 0.030%.

Molybdenum: Molybdenum acts as a solid-solubilizing enhancing element as well as has an action for promoting the fine precipitation of a carbide and suppressing the aggregation of the carbide. The addition of molybdenum may be omitted when the strength of the steel is already increased by the elements described above similarly to the boron. While an effect of addition of molybdenum is outstanding in an amount of at least 0.1%. However, when the amount exceeds 3.0%, δ-ferrite is created and the toughness is greatly deteriorated. Thus, the molybdenum content is set to 0.1 to 3.0%.

Tungsten: Tungsten has a more effect of suppressing the aggregation and coarsening of the carbide than molybdenum has and further is effective to enhance the high temperature strength such as the creep strength, the creep breaking strength and the like as a solid-solubilizing enhancing element. While an effect of addition of tungsten is outstanding in an amount of at least 0.1%. However, when the amount exceeds 4.0%, δ-ferrite is created and the toughness is greatly deteriorated. Thus, the tungsten content is set to 0.1 to 4.0%.

Note that it is sufficient that one or both of molybdenum and tungsten be contained in the material in a range of the contents thereof.

As described above, the method of manufacturing the ferritic heat-resistant steel of the present invention can manufacture ferritic heat-resistant steel, in which the MX type precipitate uniformly precipitates on the grain boundaries and in the grains and the existing ratio of the $M_{23}C_6$ type precipitate precipitating on the grain boundaries is 50% or less, by using the material containing the specific constituting elements in the specific contents and by executing the specific operation as described above, and the ferritic heat-resistant steel exhibits excellent creep characteristics that have not been experimented heretofore even at a temperature exceeding 600° C.

Next, examples of the ferritic heat-resistant steel and the method of manufacturing the same of the present invention will be exemplified below.

EXAMPLES

Examples 1 to 4 and Comparative Examples 5 to 8

Table 1 shows the chemical compositions of eight kinds of heat-resistant steels used as specimens. Among these specimens, the specimens Nos. 1 to 4 are heat-resistant steels whose chemical components are in a range of the chemical components of the present invention, whereas the specimens Nos. 5 to 8 are heat-resistant steels whose chemical components are out of a range of the chemical components of the present invention. Note that the comparative steels Nos. 5 and 6 are steels in which an additive amount of carbon is out of a range of a carbon content of the present invention, and the steel No. 6 is a steel similar to the alloy disclosed in Japanese Patent No. 2948324 described in Background Art. Further, the steel No. 7 is a steel whose additive amount of cobalt is out of a range of a cobalt amount in the present invention and is a steel similar to the alloy disclosed in JP-A No. 62-180039 described in Background Art. Further, the steel No. 8 is a steel whose additive amount of nitride is out of a range of a nitride amount in the present invention.

These heat-resistant steels were melted in a high-frequency vacuum melting furnace and then forged at a high temperature. Thereafter, the respective steels were subjected to a solution treatment in which they were held at 1050° C. for one hour and then cooled by air, and further subjected to a temper treatment at 800° C. for one hour.

TABLE 1

| | Chemical composition (wt %) | | | | | | | | | | | |
|---|---|---|---|---|---|---|---|---|---|---|---|---|
| | C | Si | Mn | Cr | W | Mo | Ni | V | Nb | Co | N | B |
| Steel of the present invention | | | | | | | | | | | | |
| 1 | 0.002 | 0.29 | 0.51 | 9.19 | 2.96 | 0.005 | 0.005 | 0.2 | 0.060 | 3.09 | 0.031 | 0.0070 |
| 2 | 0.002 | 0.29 | 0.50 | 9.17 | 2.91 | 0.005 | 0.005 | 0.2 | 0.058 | 2.94 | 0.049 | 0.0068 |
| 3 | 0.002 | 0.30 | 0.50 | 9.21 | 2.91 | 0.005 | 0.005 | 0.2 | 0.059 | 2.98 | 0.088 | 0.0069 |
| 4 | 0.009 | 0.29 | 0.50 | 9.16 | 2.71 | 0.513 | 0.005 | 0.2 | 0.059 | 2.99 | 0.050 | 0.0063 |
| Comparative steel | | | | | | | | | | | | |
| 5 | 0.05 | 0.30 | 0.51 | 9.20 | 2.92 | 0.005 | 0.005 | 0.2 | 0.057 | 2.92 | 0.053 | 0.0070 |
| 6 | 0.12 | 0.30 | 0.51 | 9.24 | 2.90 | 0.005 | 0.005 | 0.2 | 0.059 | 2.98 | 0.050 | 0.0064 |

TABLE 1-continued

| | Chemical composition (wt %) | | | | | | | | | | | |
|---|---|---|---|---|---|---|---|---|---|---|---|---|
| | C | Si | Mn | Cr | W | Mo | Ni | V | Nb | Co | N | B |
| 7 | 0.002 | 0.31 | 0.51 | 9.26 | 2.93 | 0.005 | 0.005 | 0.2 | 0.061 | 0.01 | 0.049 | 0.0065 |
| 8 | 0.002 | 0.30 | 0.50 | 9.27 | 2.93 | 0.004 | 0.005 | 0.2 | 0.058 | 3.08 | 0.002 | 0.0065 |

The respective resultant steels were subjected to a creep test at 650° C. and a creep breaking strength at 650° C. for 100,000 hours was assumed from the result of test by extrapolation. Table 2 shows the result of assumption.

TABLE 2

| | | Creep Breaking strength (kgf/mm$^2$) at 650° C. for 100,000 hours |
|---|---|---|
| Steel of the present invention | 1 | 11.3 |
| | 2 | 12.1 |
| | 3 | 12.5 |
| | 4 | 12.2 |
| Comparative steel | 5 | 10.2 |
| | 6 | 9.6 |
| | 7 | 7.3 |
| | 8 | 3.2 |

As is apparent from Table 2, the ferritic heat-resistant steels of the present invention exhibit creep breaking strengths of 650° C.×100,000 hours that are about 1.2 times greater than those of the comparative steels, and it can be confirmed that a creep breaking life is significantly long.

Figure 2:
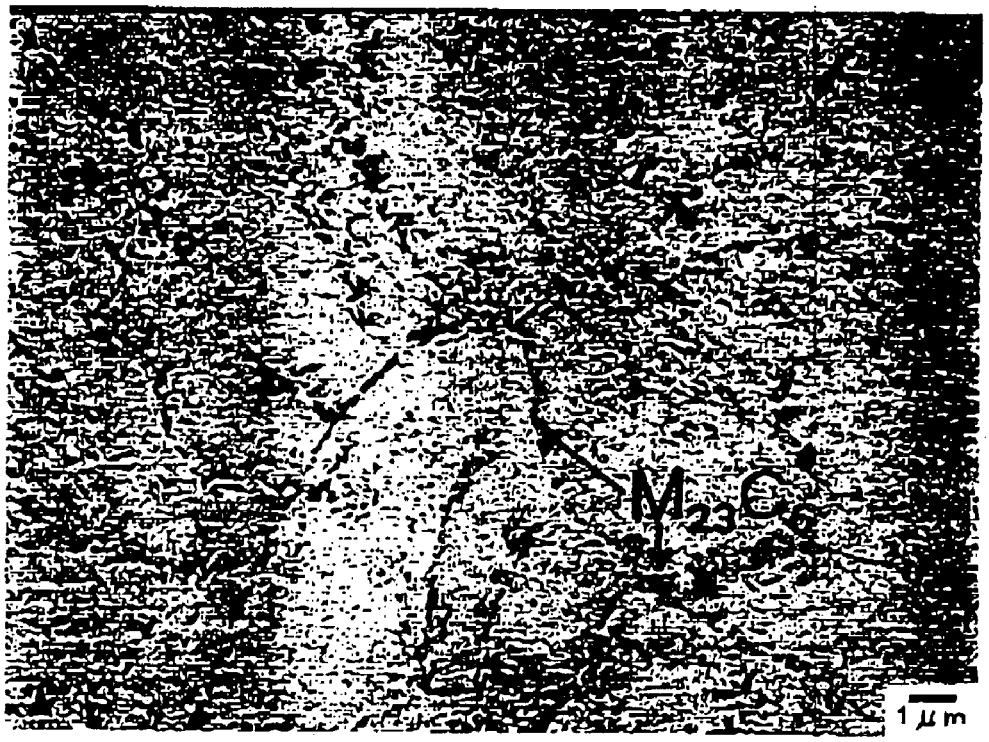
FIG. 2 is an image showing No. 6 ferritic heat-resistant steel, which will be described below, recorded by the transmission electron microscope.

Further, as can be understood from FIGS. 1 and 2, a $M_{23}C_6$ type precipitate precipitates on grain boundaries in the steel No. 6 as a comparative steel, whereas almost no $M_{23}C_6$ type precipitate is found in the heat-resistant steel No. 2 of the persent invention and a fine MX type nitride precipitates having a grain size from several nm to several tens nm precipitates on grain boundaries and in grains. Both the steels have an apparently different precipitating state.

Figure 3:
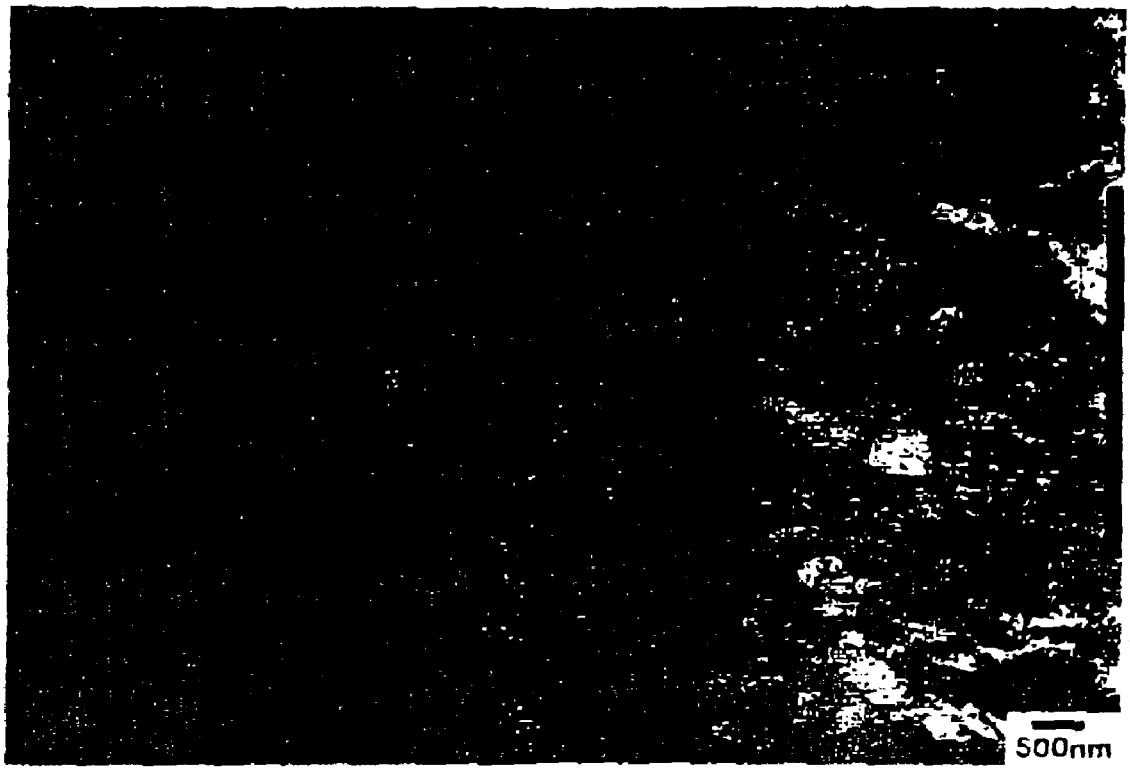
FIG. 3 is an image showing a dislocation structure of the No. 2 ferritic heat-resistant steel recorded by the transmission electron microscope.

Further, as can be understood from FIG. 3, a martensite structure is exhibited regardless of a small additive amount of carbon, from which it can be found that hardening is applied.

From the above fact, it is contemplated that the ferritic heat-resistant steel of the present invention has a unique metal structure in which the fine MX type precipitate precipitates on the grain boundaries and in the grains of a martensite structure and that the structure contributes to the great enhancement of the creep breaking strength at 650° C.

The present invention is by no means limited to the above examples. It is needless to say that various modes can be employed as to the details of the contents of the constituting elements, the method of melting and molding the material, and the specific conditions of the solution treatment and the temper treatment.

INDUSTRIAL APPLICABILITY

The ferritic heat-resistant steel of the present invention is excellent in the creep characteristics at a high temperature exceeding 600° C. Accordingly, the ferritic heat-resistant steel can be used as a high temperature member for power generation boilers and turbines, atomic power generation facilities, apparatuses in chemical industries, and the like, and it can be expected that the steel can enhance the efficiency of these apparatuses and facilities.

The invention claimed is:

1. Ferritic heat-resistant steel comprising, on the basis of percent by weight, 1.0 to 13% of chromium, 0.1 to 8.0% of cobalt, 0.01 to 0.088% of nitrogen, 3.0% or less of nickel, 0.01 to 0.060% of niobium and 0.01 to 0.50% of one or more elements selected from a group consisting of vanadium, tantalum, titanium, hafnium, and zirconium that are MX precipitate forming elements, 0.0 1% or less of carbon and a balance being substantially iron and inevitable impurities, wherein MX precipitates precipitate on grain boundaries and in entire grains, and the grain boundary existing ratio of an $M_{23}C_6$ precipitate precipitating on the grain boundaries is 50% or less.

2. The ferritic heat-resistant steel according to claim 1, further comprising 0.001 to 0.030% of boron on the basis of percent by weight.

3. The ferritic heat-resistant steel according to claim 1, further comprising one or both of 0.1 to 3.0% of molybdenum or 0.1 to 4.0% of tungsten on the basis of the percent by weight.

4. A method of manufacturing ferritic heat-resistant steel according to claim 1, comprising the step of molding a material after it has been melted and then subjecting the molded material to a solution treatment at a temperature of 1000° C. to 1300° C.

5. The method of manufacturing ferritic heat-resistant steel according to claim 4, wherein a temper treatment is executed at a temperature of 500° C. to 850° C. after the completion of solution treatment.

6. The ferritic heat-resistant steel according to claim 2, further comprising one or both of 0.1 to 3.0% of molybdenum or 0.1 to 4.0% of tungsten on the basis of the percent by weight.

7. A method of manufacturing ferritic heat-resistant steel according to claim 2, comprising the step of molding a material after it has been melted and then subjecting the molded material to a solution treatment at a temperature of 1000° C. to 1300° C.

8. A method of manufacturing ferritic heat-resistant steel according to claim 3, comprising the step of molding a material after it has been melted and then subjecting the molded material to a solution treatment at a temperature of 1000° C. to 1300° C.

9. A method of manufacturing ferritic heat-resistant steel according to claim 6, comprising the step of molding a material after it has been melted and then subjecting the molded material to a solution treatment at a temperature of 1000° C. to 1300° C.

* * * * *